US007458582B2

(12) United States Patent
Snow et al.

(10) Patent No.: US 7,458,582 B2
(45) **Date of Patent: *Dec. 2, 2008**

(54) 6-5-4 CASINO TABLE POKER GAME

(75) Inventors: Roger M. Snow, Las Vegas, NV (US); Carol Ellen Barrett, Las Vegas, NV (US)

(73) Assignee: Shuffle Master, Inc., Las Vegas, NV (US)

( * ) Notice: Subject to any disclaimer, the term of this patent is extended or adjusted under 35 U.S.C. 154(b) by 763 days.

This patent is subject to a terminal disclaimer.

(21) Appl. No.: 10/637,379

(22) Filed: Aug. 7, 2003

(65) Prior Publication Data

US 2005/0029741 A1 Feb. 10, 2005

(51) Int. Cl.
*A63F 1/00* (2006.01)

(52) U.S. Cl. ..... 273/274; 273/292

(58) Field of Classification Search ..... 273/274, 273/292, 309; 463/12, 13
See application file for complete search history.

(56) References Cited

U.S. PATENT DOCUMENTS

| | | | | |
|---|---|---|---|---|
| 4,836,553 | A | 6/1989 | Suttle et al. | |
| 4,861,041 | A | 8/1989 | Jones et al. | |
| 5,255,915 | A | 10/1993 | Miller | |
| 5,636,842 | A * | 6/1997 | Cabot et al. | 273/292 |
| 5,685,774 | A | 11/1997 | Webb | |
| 5,845,906 | A | 12/1998 | Wirth | |
| 5,851,011 | A | 12/1998 | Lott | |
| 5,897,436 | A | 4/1999 | Singer et al. | |
| 6,012,719 | A | 1/2000 | Webb | |
| 6,027,119 | A | 2/2000 | De Lisle | |
| 6,170,827 | B1 | 1/2001 | Lombardo et al. | |
| 6,206,373 | B1 | 3/2001 | Garrod | |
| 6,234,485 | B1 | 5/2001 | Perkins | |
| 6,595,520 | B1 * | 7/2003 | Richards et al. | 273/292 |
| 6,698,759 | B2 * | 3/2004 | Webb et al. | 273/292 |
| 2002/0017757 | A1 * | 2/2002 | Marchesani | 273/274 |
| 2002/0175468 | A1 * | 11/2002 | Kenny et al. | 273/274 |
| 2002/0195775 | A1 * | 12/2002 | Webb et al. | 273/292 |
| 2004/0041346 | A1 * | 3/2004 | Snow | 273/292 |
| 2004/0056418 | A1 * | 3/2004 | Wirth | 273/274 |

OTHER PUBLICATIONS

Gibson, Walter B., 1993. Four-Card Poker *Hoyle's Modern Encyclopedia of Card Games*, p. 250.

* cited by examiner

*Primary Examiner*—William M Pierce
(74) *Attorney, Agent, or Firm*—Mark A. Litman & Associates, P.A.

(57) ABSTRACT

A casino table poker game comprises a player makes an Ante wager to play in the poker game, and a first number of cards being dealt to the player. A second number of cards is dealt to a dealer. The second number of cards dealt to the dealer is greater then the first number of cards dealt to players. The dealer displays at least a first card from the second number of cards dealt to the dealer. The at least first card analyzed by an automatic game rule of play to determine whether the card must be discarded. If the rule operates to require the at least first card be discarded according to the automatic game rule, the dealer must play the dealer hand with fewer then the second number of cards dealt to the dealer. After a final number of cards has been decided in the dealer's hand, the poker game is played to conclusion according to the game rules.

21 Claims, 1 Drawing Sheet

6-5-4 CASINO TABLE POKER GAME

BACKGROUND OF THE INVENTION

1. Field of the Invention

The present invention relates to poker variants and casino table poker games in which a player competes against a dealer for payouts on wagers. In particular, the present invention relates to casino table poker games that provide a player with an enhanced perception of game outcome insight in play of a card game against a dealer hand.

2. Background of the Art

Numerous card games systems have been developed for gaming and entertainment purposes. Many of these card games systems have been adapted for use in casino wagering card games, such as blackjack and poker, to name a few. The development of successful casino card games must address several distinct criteria.

As with all successful games, a successful casino card game must be entertaining for the players and offer an apparent chance for success at the game. To be sufficiently entertaining, a card game must balance often-competing factors. These factors include complexity and challenge of game play, the pace of game play, the element of chance, the level of player skill and strategy, the amount of player interaction, the number of wagers at stake and the apparent chance of success and strategic decision making by the player.

Aside from the effect on the entertainment value of the game, the complexity of game play is of practical importance to casino type wagering games. Overly complex rules of game play will prevent the attraction of new players to a casino game and might even frustrate players familiar with the game. Simple rules allow the game to be easily accessible to all. However, overly simplistic game play often results in an unchallenging and unentertaining game.

The pace of game play is also of unique importance for a successful casino game. The rapid turnover, or cycle time, in the wagering rounds is preferred by the house in a casino game to maximize the wagering cycles of the game. This must also be balanced against how the pace of the game play affects the entertainment offered by the game. In other words, at some point, increasing the speed of the game past a certain point will reduce the entertainment value of the game. Some players feel pressured if the game moves too fast.

Regarding the element of chance, it is fundamental to casino type games that the element of chance plays a substantial role in the game. The player preferably would like to feel that some control can be exercised by players to enhance their chance of winning. At the same time, a game based solely on skill in making strategic decisions may tend to intimidate new players in a casino game environment. Additionally, if skill could be exercised that would actually shift statistical advantage in favor of the player, casinos would not offer the game. However, in most casino card games, winning is based on a combination of skill and the element of chance, where a player's increased skill will increase his likelihood of winning for short periods during repeated play. Consequently, the element of chance and the level of player skill and strategy necessary are both of importance in player perception and the casinos ability to offer the game.

Many different variations in the play of casino table poker games have been offered to provide a wide range of game play and maintain player interest in table games.

U.S. Pat. No. 6,170,827 B1 (Lombardo et al.) describes a casino table card game in which a greater number of cards are provided to a dealer than to a player. The player provides a first stake and designating a portion of his lesser number of cards to correspond to that first stake. The cards dealt to a player (e.g., 4 initial cards) are split into two hands, each of which has a separate stake, and each of which plays against two hand segments established by the dealer. The player may also rearrange cards in the first segment, if the player's hand ties the dealer's hand.

U.S. Pat. No. 4,836,553 (Suttle et al.) describes the basic play of Caribbean Stud® poker. A five card hand is dealt to each player and to a dealer after an ante bet is made. One card from the dealer's hand is exposed. The player may place a wager that is a multiple (usually 2× the ante) to stay in the game after viewing the dealer's partially disclosed hand (e.g., the single up card). Bonus bets are paid in this game, only when the player attains a ranked hand and beats the dealer's hand.

U.S. Pat. No. 4,861,041 (Jones et al.) describes the optional side bet made on bonus play in table games, specifically in Caribbean Stud® poker. With placement of the side bet, bonus hands are rewarded, even if the dealer beats the ranked hand of a player or does not qualify with a minimum hand ranking.

U.S. Pat. No. 5,685,774 (Webb) describes a casino table poker game in which separate bets may be placed by a player that a player's hand will either exceed a predetermined rank or beat the dealer's hand. At least one, but not necessarily both bets may be placed. A third optional bet is available that backs up the wager as to whether the player's hand will exceed the rank of the dealer's hand. Wild cards are available, and an initial hand of four cards may be dealt to the player.

U.S. Pat. No. 6,012,719 (Webb) describes the basic game of three-card poker, which combines the play of Blackjack, a three-card poker game, and a side bet. A dealer's card is combined into the player's first two cards for the three-card poker play.

U.S. Pat. No. 5,851,011 (Lott) describes a poker-type game with multiple wagers, jackpots and insurance options. Multiple players wager on a single five-card player hand which competes against a single seven card dealer hand from which five dealer cards are selected to form a dealer's hand. Players win or lose as a group.

U.S. Pat. No. 6,027,119 (De Lisle) describes a method of playing a card game (non-poker type) wherein players' and dealer's hands are valued by determining the suit (in each hand) where the player's and dealers 'points' are highest. There are optional call bets at various points of hand disclosures.

U.S. Pat. No. 5,897,436 describes a modified poker game in which a player builds a hand, being dealt two cards at a time and discarding one card at a time, until a hand is built of a predetermined number of cards.

U.S. Pat. No. 6,206,373 B11 describes a method of playing a card game with a dealer's hand that has a permanent displayed card (e.g., the Ace of Spades). From the remainder of the deck, each player is dealt two face-down cards, and each player may act on their cards, being given an option to continue or fold and receive a portion of the wager back. Then five common cards are dealt face up, with the common cards being common to both the dealer's and the players' hands. Players may receive awards for bonus hands.

U.S. Pat. No. 6,234,485 (Perkins) allows a player to purchase a bonus card in the play of a casino table poker game, the card being delivered when the first five cards is a losing hand.

U.S. Pat. No. 5,845,906 teaches the potential for the option of using a sixth card in a dealer-vs.-player casino table five card poker game.

U.S. Pat. No. 5,255,915 describes an electronic six card poker hand, with an option of drawing cards available, and an optional sequence of wagers.

Shuffle Master Inc.'s U.S. patent application Ser. No. 10/277,508 describes a game in which a Player may get additional cards when the player's hand has a low value. This activity does not require a side wager.

In spite of the availability of many casino table card games in the literature, only a few games have been widely successful in the casino gaming market. It is therefore desirable to provide a greater variety of games from which more successful table games can be found.

SUMMARY OF THE INVENTION

A method of playing a poker game comprises a player making an Ante wager to participate in a poker game. A first number of cards is dealt to each player making a wager and a second number of cards is dealt to a dealer. The second number dealt to the dealer is greater than the first number. The dealer displays at least a first card from the second number of cards. The game rules may require that the dealer discard the displayed first card from the dealer hand, particularly if there is a player perception (according to rules) that the displayed card is a card of high rank or value. The game rules are automatic and do not allow the dealer to exercise judgment in discarding of the first displayed card. The dealer and the player then proceed to play the poker game to conclusion according to the game rules.

Another example of the game of the present invention is a method of playing an X-card poker game comprising a player making an Ante wager to play in the poker game, and dealing a first number of X cards to a player. A second number of at least X+1 or X+2 or X plus more cards is dealt to a dealer. The dealer then displays at least a first card from the second number of cards. The displayed first card is considered with respect to automatically played game rules. One possible effect of the automatic game rules is to require the dealer to discard the displayed dealer's first card, especially if the card exceeds a particular rank (e.g., at least a 10, at least a Jack, at least a Queen, at least a King or an Ace). The dealer then displays another card to the table. Where X+2 cards are provided, the dealer may be required to determine by automatic game rules whether or not to discard another card by following the game rule that the dealer discards or does not discard another card based on rank, suit or rank and suit. The poker game is then played to conclusion according to the game rules. Additional side bets are available in addition to the play of the underlying game.

GAME DESCRIPTION

Figure 1:
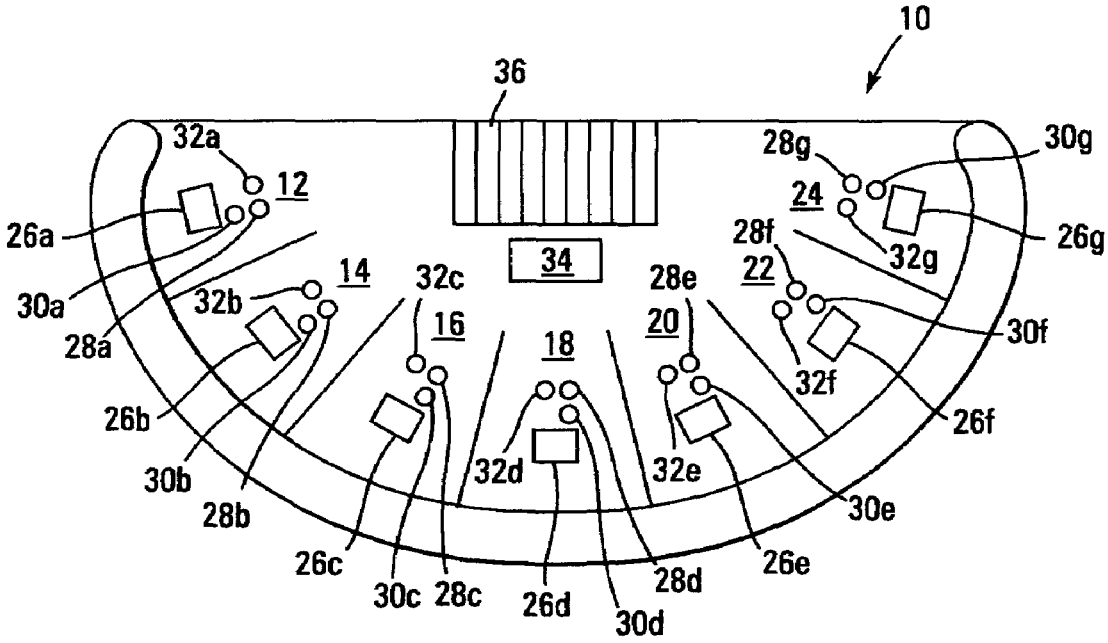
FIG. 1 is a top plan view of a playing surface for playing a casino card game of the present invention.

An exemplary game according to the present invention is a variant of poker, particularly a variant of stud poker, particularly 3-card, 4-card, 5-card, 6-card and 7-card stud poker, although wild card variants of the game may also be played. An underlying concept in the play of the present poker game is that the player competes against a dealer for the best hand ranking. The dealer is provided a first number of cards, and then the dealer is required to display at least a first card. When the dealer's first displayed card is at least a predetermined at least a minimum rank (according to game rules) that might be considered favorable to the dealer or disadvantageous to the player, that card must be discarded. This procedure may be repeated more than once, depending upon the initial number of cards provided to the dealer and the minimum number of cards that the dealer must retain to play in the game. The players are then dealt a hand of cards, typically one or two cards fewer than the dealer's initial hand. After the final number of cards have been determined for the dealer (and the players), the game proceeds to its resolution according to the game rules.

The game of the invention is preferably played with a standard single 52-card playing deck of cards, although wild cards or special cards may be provided and the underlying concept of the invention practiced. Multiple decks or special decks may also be used. In addition to the underlying dealer versus player poker game, side wagers or side bets may be made on special games or bonuses that are played without interruption or change in strategy in the underlying game. These side bets may be for attaining hands of predetermined ranks, special cards in the deck, jackpot hands, strings of like card ranks, play in progressive jackpot games, random awards, games played with discards or residual cards, match card games, and the like.

The game of the present invention will be described in greater detail below, with a representative game of 4-Card poker played between the dealer and the player. The dealer is dealt six (6) initial cards and the player is dealt five (5) initial. The game is played with the potential for the dealer to be compelled to discard up to two (2) cards so that the dealer will play the 4-Card poker game by selected from a dealer card hand of either 6 cards, 5 cards or 4 cards. This game will be referred to as 6-5-4 Stud Poker™ game or 6-5-4 Poker™ game. The players will be dealt five cards and will discard one card to make their best four card hand.

A preferred version of the 6-5-4 Poker™ game can be generally described as follows:

A) A single standard 52-card playing card deck is used to play the game and each player makes an Ante wager to enter the game;

B) Players who have made the Ante wager are dealt five cards (four cards may also be dealt to players) each to make their best 4-card poker hand. The dealer is initially dealt either six cards but could be dealt five cards. Depending on rules and events in the play of the game, the dealer gets either 6-cards, 5-cards or 4-cards to play the round of the game, depending upon how high the rank of individually exposed cards are at various stages of play.

C) The basic game is played by steps C)-F) where the dealer originally is (by way of example) dealt six cards, with five cards face down and one card face-up.

D) If the dealer's first face-up card is a rank of 10 or higher (this is a particularly effective rank, but it is possible to change the predetermined rank to 9 or higher, Jack or higher, Queen or higher, King or higher or Ace, or if a wild card is present, a wild card which would be included in "higher" for any other predetermined rank), that card is discarded from the dealer's hand, leaving a working hand of five cards face down. A second card is then turned face-up from the dealer's remaining five cards. The player has not had to make any strategy decisions at this time.

E) If the second face-up card has a rank of 10 or higher, that second face-up card is discarded, leaving the dealer with a 4-card hand, with four cards facing down. If the card is a 9 or lower, the card remains in the hand.

F) When the dealer has a 4 card hand, one dealer card of the four may optionally be turned up for the players to observe.

G) The first game wager (Ante) was placed by each player in the game before step B).

H) A second "Queens Up" bonus bet may be optionally made by each player before step B), wagering in the bonus bet that the player's resulting 4-card poker hand will have a poker rank of a Queen high or better.

I) Each player must decide whether to continue play of the game (by placing a second game bet or play bet) or fold after the dealer has determined by the rules of the game in steps C)-F) how many cards will be present in the dealer's hand, and by any information provided by dealer up cards.

J) The Play Wager is equal to the Ante in a preferred form of the invention. In other forms of the invention, the play bet is more or less than the Ante.

K) The Play in the underlying game on the Ante and the Play Wager is Player vs. Dealer. The highest hand wins. In one form of the invention, each player makes his best four card hand from the five available cards. If the Player wins, the Ante and Play Wager are paid, the Ante being paid at least one-to-one. Typically the Ante and Bet are paid 1:1 but other pay structures such as 2:1 or 3:1, etc. are contemplated by the present invention. If the Dealer wins, the Dealer collects both the Ante and Play Wager. If the Dealer's hand and Player's hand tie, the Ante and the Play Wager bets are a push.

L) There is an Ante Bonus that is paid for high-ranking hands, independent of the Queens Up bonus event. This payout is based solely on the Ante and does not require an independent wager. One exemplary Ante Bonus may be paid for attaining at least a Straight Flush. A typical pay table is shown below.

Ante Bonus Payouts

| Hand | Payout |
|---|---|
| Four Aces | 100:1 |
| Four of a Kind | 20:1 |
| Straight Flush | 10:1 |

M) Winning Hand Ranking on the 4-card poker Ante bonus is (High to Low): 4 Aces, Four-of-a-Kind, and Straight Flush.

N) The Queens Up bet is a side bet against a pay table. The pay table is a compilation of winning arrangements of cards and corresponding payout odds. Typically the pay table lists winning hand arrangements in descending order. A typical Queens UP Pay table is shown below:

Queens Up Side Bet Payouts

| Hand | Payout |
|---|---|
| 4 of a Kind | 50:1 |
| Straight Flush | 40:1 |
| 3 of a Kind | 8:1 |
| Flush | 4:1 |
| Straight | 3:1 |
| Two Pair | 2:1 |
| Pair of Queens or Better | 1:1 |

Payouts on the Queens Up side bet are independent of the relative rank between a Player's hand and the Dealer's hand. When the Player has made the Queens Up bet and is dealt a hand with a rank of a Pair of Queens or higher, the Player is paid odds on the amount of the Queens Up wager. The amount of the Queens Up wager may be placed independently up to the Table Limit.

O) Table hand ranking on the Queens Up side bet is identical to play of the underlying 4-card poker game. The side bet on Queens Up also pays for Three-of-a-Kind, Flush, Straight, 2 Pair and Pairs of Queens or higher, in descending order.

Other variations in the game are possible based on the above-described play of a preferred version of the game of the invention exemplified by the 6-5-4 Poker™ game. For example, after step D), the player may be allowed to surrender a portion of the player's wager, for example half the wager rather than fold. Variations in the amount of the play wager (e.g., from 1× to 1.5×, 2×, 2.5×, 3× and more) may be allowed, either as a fixed wager required or at the option of the player.

Within the scope of the invention that has been defined, there are a number of features that can be identified as unique to the practice of the present invention. Among these features are at least believed to be:

1) The use of automatic rules in a Casino Table Poker game that require a dealer to discard at least one card, independent or dependent on rank, and/or suit.

2) Potentially requiring a dealer to discard more than one card from a hand with a fixed number of cards.

3) Potentially discarding a variable number of cards from the dealer's hand only.

4) Allowing a player to alter an initial wager after a dealer has been compelled to discard cards of rank that were potentially advantageous to the dealer.

The following example will describe a complete round of play of the exemplary 6-5-4 Poker™ game of the present invention. For simplicity, the table will be described with four players present in positions 12, 14, 16 and 18 and a dealer, when additional players (typically 7) could be at a table. A standard 52-card deck without wild cards or jokers is used.

A table 10 similar to a standard blackjack table is provided as shown in FIG. 1. There are seven player positions, 12, 14, 16, 18, 20, 22 and 24 and one dealer position. At each player position there is an area for receiving cards 26*a-g*, an area 28*a-g* for placing an Ante Wager, an area 30*a-g* for placing a Play wager, and an area 32*a-g* for placing a side bet bonus wager on the above described Queens Up bonus wager. The first two players (in areas 12 and 14) place $5.00 Ante Wagers and $5.00 Queens Up side bets. The second two players (in areas 16 and 18) place $5.00 Ante Wagers and no Queens Up wagers. No players are present in areas 20, 22 and 24.

The dealer is dealt six (6) cards face down in area 34 in front of chip tray 36 and each of the players is dealt five (5) cards face down into areas 26*a-g*. The cards are dealt in batches of five cards to each player and six cards to the dealer after all initial wagers are placed (the Ante and the Queens Up side bet). The players can examine their cards at this time. It does not actually matter (as far as individual players are concerned) whether player cards are exposed or not, but to limit player knowledge of potential cards in the dealer's hand, the player cards remain face down and unexposed to other players.

The dealer then turns up one of the initial six (6) cards dealt to the dealer, typically the last card dealt. If the card is a rank of 10 or higher (e.g., 10, Jack, Queen, King or Ace), the dealer must discard that first card that was turned face up. Players may be required to place their Play Wager at this time, even before a second card is turned face up, but that is a game variant not present in this example. If the first card turned up was a rank of nine (9) or lower, that card would be retained as the up card for the dealer, and the players are then required to make a decision on whether to fold (discard their hand and give their Ante Wager to the casino) or place the Play Wager.

In this example, the first card the dealer turns up is the Jack of hearts (the, suit is immaterial in this example) and therefore must discard the Jack of hearts because the rank exceeds 10 or higher. The players are not required to make a Play Wager at this time, but may wait until the dealer turns up and exposes a second card from the remaining 5-Card working hand. Again, if the second turned up card is a predetermined minimum rank (it will be assumed that the predetermined rank is the same for the second card as it is for the first turned up dealer's card, but that is not essential), that card must be discarded. Another variant would be to discard if a predetermined maximum rank was not met. After the automatic rule has been exercised as to whether the second turned up card must be discarded or retained, the players must decide whether to fold their hand or make the Play Wager.

It is assumed in this example that the second card was a King of diamonds because the rule in the example of the invention is to discard a second card that is 10 or higher in rank. The dealer must discard the King of diamonds. The dealer then exposes a third card, (of four available cards) which remains turned up and remains in play. The first two discards from the dealer's hand (the Jack of hearts and the King of diamonds) have been placed in a discard rack and are no longer in play. The dealer now turns up the eight of spades as the third exposed card.

The players now have five cards from which to build a best 4-card poker hand, while the dealer must play the four cards that remain in the dealer's position. This possibility gives a significant appearance and perception of potential player advantage and constitutes one of the attractive player features of the 6-5-4 Poker game.

The first player in position 12 examines his five card hand, finds there are two pairs (e.g., six of Hearts and six of clubs, nine of diamonds and nine of spades) in that players hand, decides to remain in play of the game, and places a $5.00 Play Wager on the table.

The second player in position 14 examines his five card hand, finds there is a pair of threes (e.g., three of clubs and three of diamonds) in that player's hand, decides to remain in play of the game, and places a $5.00 Play Wager on the table.

The third player in position 16 examines his five card hand, finds there are three-of-a-kind (e.g., Queen of Hearts, Queen of clubs, and Queen of diamonds) in that players hand, decides to remain in play of the game, and places a $5.00 Play Wager on the table.

The fourth player in position 18 examines his five card hand, finds there are no pairs or any hands of winning rank, decides to withdraw from play of the game, and places no Play Wager on the table. The fourth player loses his Ante and Queens Up bonus bet, if made.

The dealer then confirms that all player decisions have been made and then turns the dealer's hand over to expose all cards to the table, revealing the three cards that have been face down until this point. The dealer's hand is found to have a pair of sixes (e.g., six of clubs and six of hearts). The dealer arranges the dealer's hand on the table so that all player's can view the cards and then proceeds to arrange player hands one at a time to evaluate their highest rank from among the five cards and arrange the highest ranking player hand at each position for ease of view. The first player hand with two pair is displayed, the player paid 1:1 on the Ante Wager, 1:1 on the Play wager, and is paid 2:1 on the Queens Up bet for two pair. The player hand at the first position 12 is then removed and placed into a discard pile or rack. The dealer then moves to the second player hand.

The second player hand of a pair of three's at position 14 loses all of the Ante Wager, the Play Wager and the Queens Up side bet. The second player hand is removed from the table and the wagers and side bet are removed by the casino.

The third player hand is 3 Queens, wins the Ante Wager and the Play Wager because the hand beat the pair of 6's, but no Queens Up wager was made. If there are special Ante Wager bonuses for hands of particularly high ranks, the three-of-a-kind might be paid a bonus. However, in a preferred form of play, the player hand must be a straight flush or better to win an Ante bonus. Otherwise, the wager is resolved on the Ante Wager and Play Wager, the player being paid 1:1 or both the Ante and Play wagers, and the third player hand is removed from the table.

The fourth player hand had already been removed, so it is not in play.

The dealer then shuffles the cards and another round of play is engaged.

Although specific examples and features have been described, alternative embodiments are within the skill of the artisan for use with the underlying game of the invention. The game may be played with players receiving exactly the number of cards needed to form the competing hand or may receive more than enough cards to form the competing hand and they select from the available cards to form the best competing hand. Wild cards may be added, and additional side bets may be made on the game, such as wagering how many dealer cards will be discarded on a hand.

What is claimed:

1. A method of playing a poker game comprising:

a player makes an Ante wager to play in the poker game, a first number of X cards is dealt to the player, a second number of at least X+1 cards is dealt to a dealer, the second number of cards dealt to the dealer being greater then the first number of X cards dealt to the player, displaying at least a first displayed card from the second number of cards dealt to the dealer, game rules requiring the dealer to discard the at least first displayed card according to a first game rule in which the dealer is not allowed to exercise any judgment in discarding of the first displayed card, the first game rule being one of the rules of the game, the discarding done before the dealer's hand is turned over to expose all the dealer's cards to the table;

wherein the first game rule of the rules of the poker game requires a discard from the dealer's hand of at least X+1 cards and turning over another card from the dealer's hand so that one card is face-up, allowing the dealer to play the dealer hand with fewer then the second number of cards dealt to the dealer, and playing the poker game to conclusion according to the rules of the game.

2. The method of claim 1 wherein after a final number of cards in the dealer's hand has been determined, requiring the player to either a) fold and forfeit the Ante wager or b) make a play wager to stay in the poker game.

3. A method of playing an X-card poker game having game, rules comprising a player making an Ante wager to play in the poker game, dealing a first number of X cards to a player and dealing a second number of at least X+1 cards to a dealer as a dealer's hand, displaying suit and rank of at least a first displayed card from the second number of X+1 cards, the dealer being required to discard a first displayed card of the at least X+1 cards dealt to the dealer according to a first game rule of rules of the game in which the dealer is not allowed to exercise any judgment in discarding the at least first displayed card, the discarding done before the dealer's hand is turned over to expose suit and rank of all the dealer's cards to the table;

wherein the first game rule of the rules of the game requires a discard from the dealer's hand of at least X+1 cards, and turning over another card from the dealer's hand so that one card is face-up, and playing the poker game to conclusion according to the game rules.

4. The method of claim 3 wherein the second number of at least X+1 cards consists of X+2 cards.

5. The method of claim 4 wherein X+2 is six.

6. The method of claim 5 wherein after a final number of cards in the dealer's hand has been determined, requiring the player to either a) fold and forfeit the Ante wager or b) make a play wager to stay in the poker game.

7. The method of claim 6 wherein a side bet wager may be placed on a player attaining at least a predetermined rank to win payoffs that may exceed the amount of the side bet.

8. The method of claim 5 wherein after turning over another card, determining by a second game rule whether or not to discard the another card and acting on that second game rule to discard or not discard the another card.

9. The method of claim 8 wherein after a final number of cards in the dealer's hand has been determined, requiring the player to either a) fold and forfeit the Ante wager or b) make a play wager to stay in the poker game.

10. The method of claim 4 wherein after turning over another card to show suit and rank, determining by a second game rule whether or not to discard the another card and acting on that second game rule to discard or not discard the another card.

11. The method of claim 10 wherein after a final number of cards in the dealer's hand has been determined, requiring the player to either a) fold and forfeit the Ante wager or b) make a play wager to stay in the poker game.

12. The method of claim 4 wherein after a final number of cards in the dealer's hand has been determined, requiring the player to either a) fold and forfeit the Ante wager or b) make a play wager to stay in the poker game.

13. The method of claim 12 wherein a side bet wager may be placed on a player attaining at least a predetermined rank to win payoffs tat may exceed the amount of the side bet.

14. The method of claim 4 wherein X is four, the game rules require a player to place a play wager after viewing the player's hand and the play wager must be between 1 times and 2 times the Ante wager, inclusively.

15. The method of claim 14 wherein the first game rule requires that the another up card be discarded if its rank equals or exceeds a second predetermined minimum rank.

16. The method of claim 14 and further comprising a second game rule requiring that the another card from the dealer's hand must be discarded if its rank equals or exceeds a second predetermined rank, wherein the first predetermined minimum rank and the second predetermined minimum rank are different ranks.

17. The method of claim 3 wherein after a final number of cards in the dealer's hand has been determined, requiring the player to either a) fold and forfeit the Ante wager or b) make a play wager to stay in the poker game.

18. The method of claim 17 wherein a side bet wager may be placed on a player attaining at least a predetermined rank to win payoffs that may exceed the amount of the side bet.

19. The method of claim 3 wherein the first game rule requires that a first dealer's up card be discarded if its rank equals or exceeds a first predetermined minimum rank.

20. The method of claim 19 and further comprising a second game rule requiring that the another card from the dealer's hand must be discarded if its rank equals or exceeds a second predetermined rank, wherein the first predetermined minimum rank and the second predetermined minimum rank are the same rank.

21. The method of claim 3 wherein a side bet wager may be placed on a player attaining at least a predetermined rank to win payoffs that may exceed the amount of the side bet.

* * * * *